US008674927B2

(12) United States Patent
Park et al.

(10) Patent No.: US 8,674,927 B2
(45) Date of Patent: Mar. 18, 2014

(54) LIQUID CRYSTAL DISPLAY AND METHOD OF DRIVING THE SAME

(75) Inventors: Yun-Jae Park, Yongin-si (KR); Hyun-Seok Ko, Seoul (KR); Mun-Soo Park, Suwon-si (KR); Seung-Hwan Moon, Yongin-si (KR); Kyung-Uk Choi, Asan-si (KR)

(73) Assignee: Samsung Display Co., Ltd. (KR)

( * ) Notice: Subject to any disclaimer, the term of this patent is extended or adjusted under 35 U.S.C. 154(b) by 783 days.

(21) Appl. No.: 12/239,595

(22) Filed: Sep. 26, 2008

(65) Prior Publication Data

US 2009/0109167 A1 Apr. 30, 2009

(30) Foreign Application Priority Data

Oct. 30, 2007 (KR) ..... 10-2007-0109658

(51) Int. Cl.
*G09G 3/36* (2006.01)

(52) U.S. Cl.
USPC ..... 345/102

(58) Field of Classification Search
USPC ..... 345/84, 87, 102, 690
See application file for complete search history.

(56) References Cited

U.S. PATENT DOCUMENTS

| | | | | |
|---|---|---|---|---|
| 7,277,079 | B2 * | 10/2007 | Kobayashi et al. | 345/102 |
| 2003/0038770 | A1 * | 2/2003 | Lee et al. | 345/102 |
| 2005/0134614 | A1 * | 6/2005 | Tomohara | 345/690 |
| 2006/0187181 | A1 * | 8/2006 | Kim | 345/102 |
| 2006/0267922 | A1 * | 11/2006 | Kim | 345/102 |
| 2007/0046485 | A1 * | 3/2007 | Grootes et al. | 340/815.45 |
| 2007/0091059 | A1 * | 4/2007 | Kang | 345/102 |
| 2007/0262948 | A1 * | 11/2007 | Han et al. | 345/102 |
| 2008/0007512 | A1 * | 1/2008 | Honbo | 345/102 |
| 2008/0018587 | A1 * | 1/2008 | Honbo et al. | 345/102 |
| 2008/0074381 | A1 * | 3/2008 | Kumamoto | 345/102 |
| 2009/0051629 | A1 * | 2/2009 | Price et al. | 345/82 |

* cited by examiner

*Primary Examiner* — Pegeman Karimi
(74) *Attorney, Agent, or Firm* — Innovation Counsel LLP

(57) ABSTRACT

Provided are a liquid crystal display (Lcd) and a method of driving the same. The LCD includes a timing controller which receives a first image signal corresponding to a first frame frequency and outputs a second image signal corresponding to a second frame frequency; a liquid crystal panel which receives the second image signal and displays an image using the second frame frequency; and a plurality of light-emitting blocks which provide light to the liquid crystal panel, wherein the light-emitting blocks are divided into a plurality of light-emitting groups, each group including at least one of the light-emitting blocks, and, in a first operation mode, a frame, which corresponds to the second frame frequency, includes an off section in which at least one of the light-emitting groups is turned off.

20 Claims, 15 Drawing Sheets

< 2nd MODE >

< 1st MODE >

LIQUID CRYSTAL DISPLAY AND METHOD OF DRIVING THE SAME

This application claims priority under 35 U.S.C. §119 to Korean Patent Application No. 10-2007-0109658 filed on Oct. 30, 2007 in the Korean Intellectual Property Office, the disclosure of which is incorporated herein by reference in its entirety.

BACKGROUND OF THE INVENTION

1. Field of the Invention

The present invention relates to a liquid crystal display (LCD) and a method of driving the same.

2. Description of the Related Art

A liquid crystal display (LCD) includes a first display substrate having a plurality of pixel electrodes, a second display substrate having a plurality of common electrodes, and a liquid crystal panel having a dielectrically anisotropic liquid crystal layer injected between the first and second display substrates. The LCD displays a desired image by forming an electric field between the pixel electrodes and the common electrodes, adjusting the intensity of the electric field, and thus controlling the amount of light that transmits through the liquid crystal panel. Since the LCD is not a self light-emitting display, it includes a plurality of light-emitting blocks.

Recently, a technology, which controls the luminance of each light-emitting block according to an image displayed on the liquid crystal panel to enhance image quality, is being developed.

SUMMARY OF THE INVENTION

Aspects of the present invention provide a liquid crystal panel (LCD) with enhanced display quality.

Aspects of the present invention also provide a method of driving an LCD with enhanced display quality.

However, aspects of the present invention are not restricted to the one set forth herein. The above and other aspects of the present invention will become apparent to one of ordinary skill in the art to which the present invention pertains by referencing the detailed description of the present invention given below.

According to an aspect of the present invention, there is provided an LCD including a first timing controller which receives a first image signal corresponding to a first frame frequency and outputs a representative image signal corresponding to the first frame frequency and a second image signal corresponding to a second frame frequency; a liquid crystal panel which is divided into a plurality of display blocks, receives the second image signal, and displays an image in the second frame frequency; a second timing controller which receives the representative image signal corresponding to the first frame frequency and outputs an optical data signal; and a plurality of light-emitting blocks which correspond to the display blocks, respectively, and provide light to the liquid crystal panel in response to the optical data signal, wherein the light-emitting blocks are divided into a plurality of light-emitting groups, each group including at least one of the light-emitting blocks, and, in a first operation mode, a frame, which corresponds to the second frame frequency, includes an off section in which at least one of the light-emitting groups is turned off.

According to another aspect of the present invention, there is provided a method of driving an LCD which includes a liquid crystal panel and a plurality of light-emitting blocks providing light to the liquid crystal panel. The method includes receiving a first image signal which corresponds to a first frame frequency and outputting a second image signal which corresponds to a second frame frequency; receiving the second image signal and displaying an image in the second frame frequency; and providing the light to the liquid crystal panel, wherein the light-emitting blocks are divided into a plurality of light-emitting groups, each group including at least one of the light-emitting blocks, and, in a first operation mode, a frame, which corresponds to the second frame frequency, includes an off section in which at least one of the light-emitting groups is turned off.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION OF THE INVENTION

Figure 1:
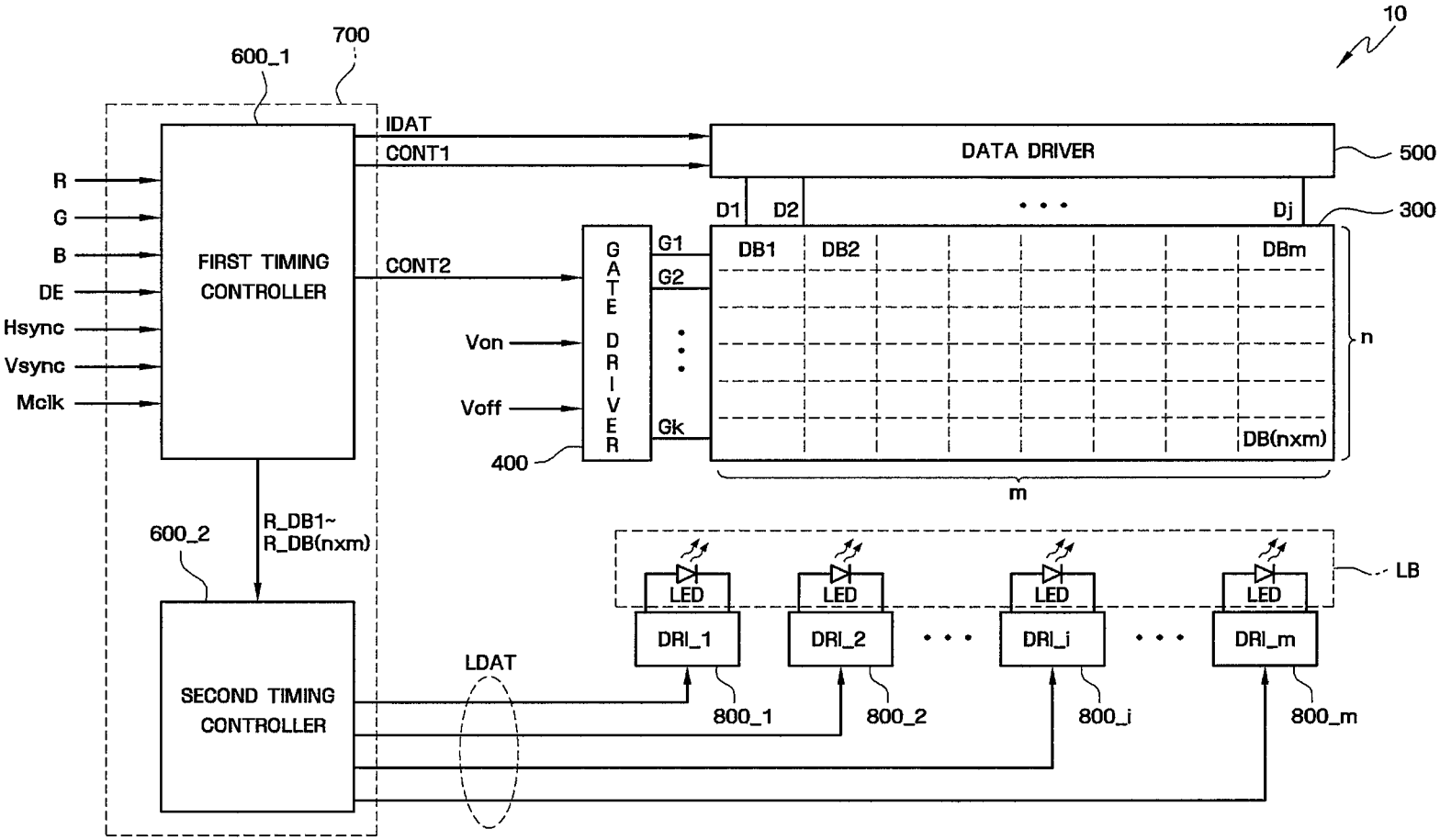
FIG. 1 is a block diagram of a liquid crystal display (LCD) according to an embodiment of the present invention.

Advantages and features of the present invention and methods of accomplishing the same may be understood more readily by reference to the following detailed description of embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, and/or sections, these elements, components, and/or sections should not be limited by these terms. These terms are only used to distinguish one element, component, or section from another element, component, or section. Thus, a first element, component, or section discussed below could be termed a second element, component, or section without departing from the teachings of the present invention.

The terminology used herein is for the purpose of describing embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless explicitly stated otherwise, all of the terminologies (including technical and scientific terminologies) used herein may be used as meaning that those skilled in the art can commonly understand. Further, terminologies defined in ordinary dictionaries should not be ideally or excessively construed, unless explicitly stated otherwise.

Hereinafter, a case where a liquid crystal display (LCD) operates in first and second operation modes will be described as an example. However, the present invention is not limited thereto. That is, the LCD may operate in the first or second operation mode or in another mode that is not disclosed below.

Figure 2:
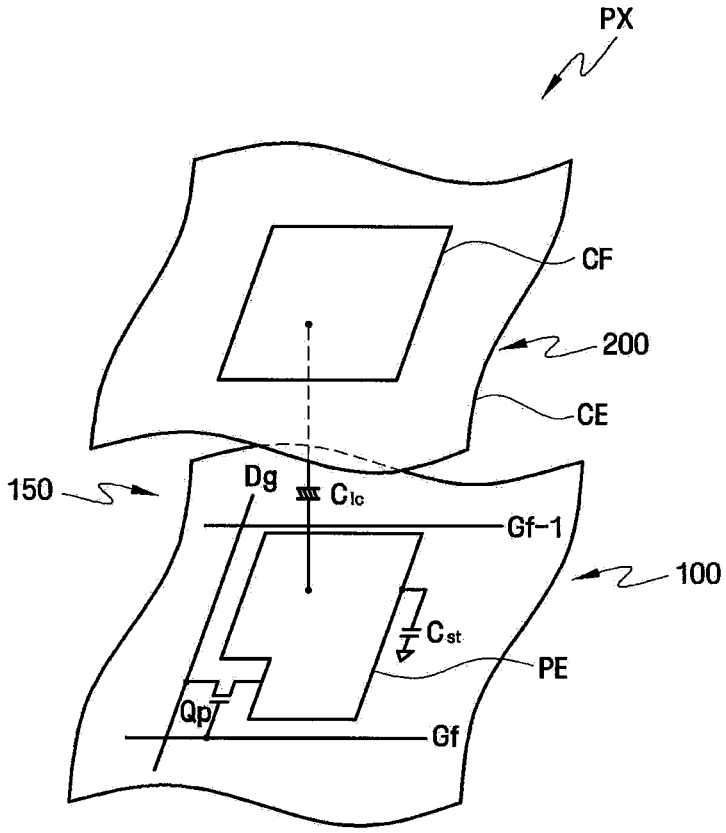
FIG. 2 is an equivalent circuit diagram of a pixel.
Figure 3:
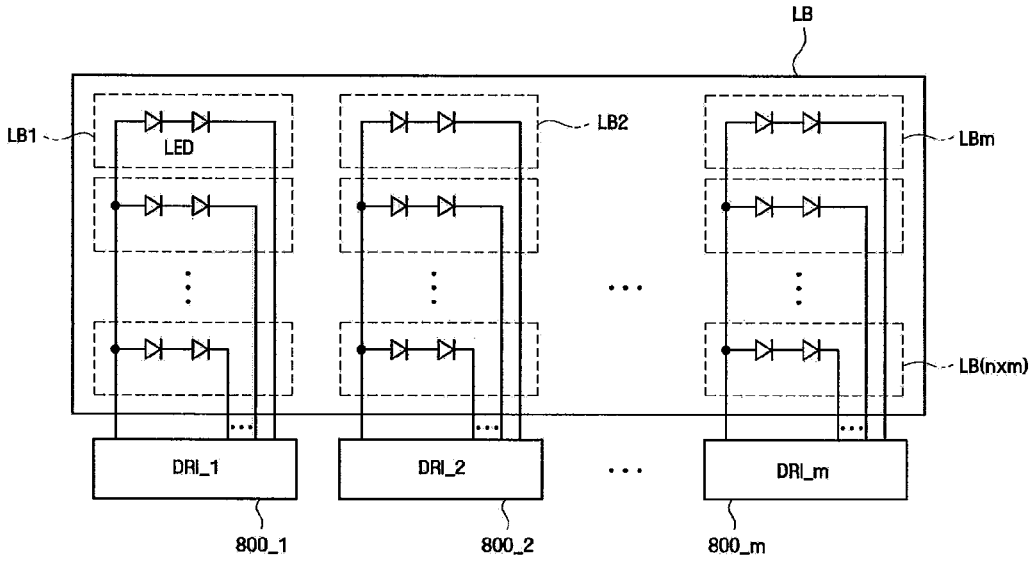
FIG. 3 is a block diagram for explaining the arrangement of first through $(n\times m)^{th}$ light-emitting blocks illustrated in FIG. 1 and the connection relationship between the first through $(n\times m)^{th}$ light-emitting blocks and first through $m^{th}$ backlight drivers.
Figure 4A:
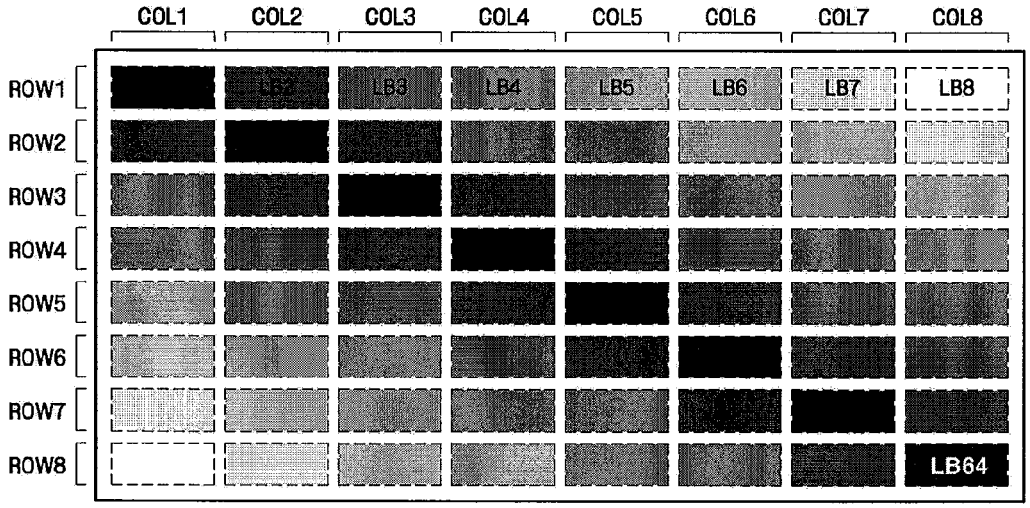
FIG. 4A is a conceptual diagram for explaining the operations of the first through $(n\times m)^{th}$ light-emitting blocks in a second operation mode.
Figure 4B:
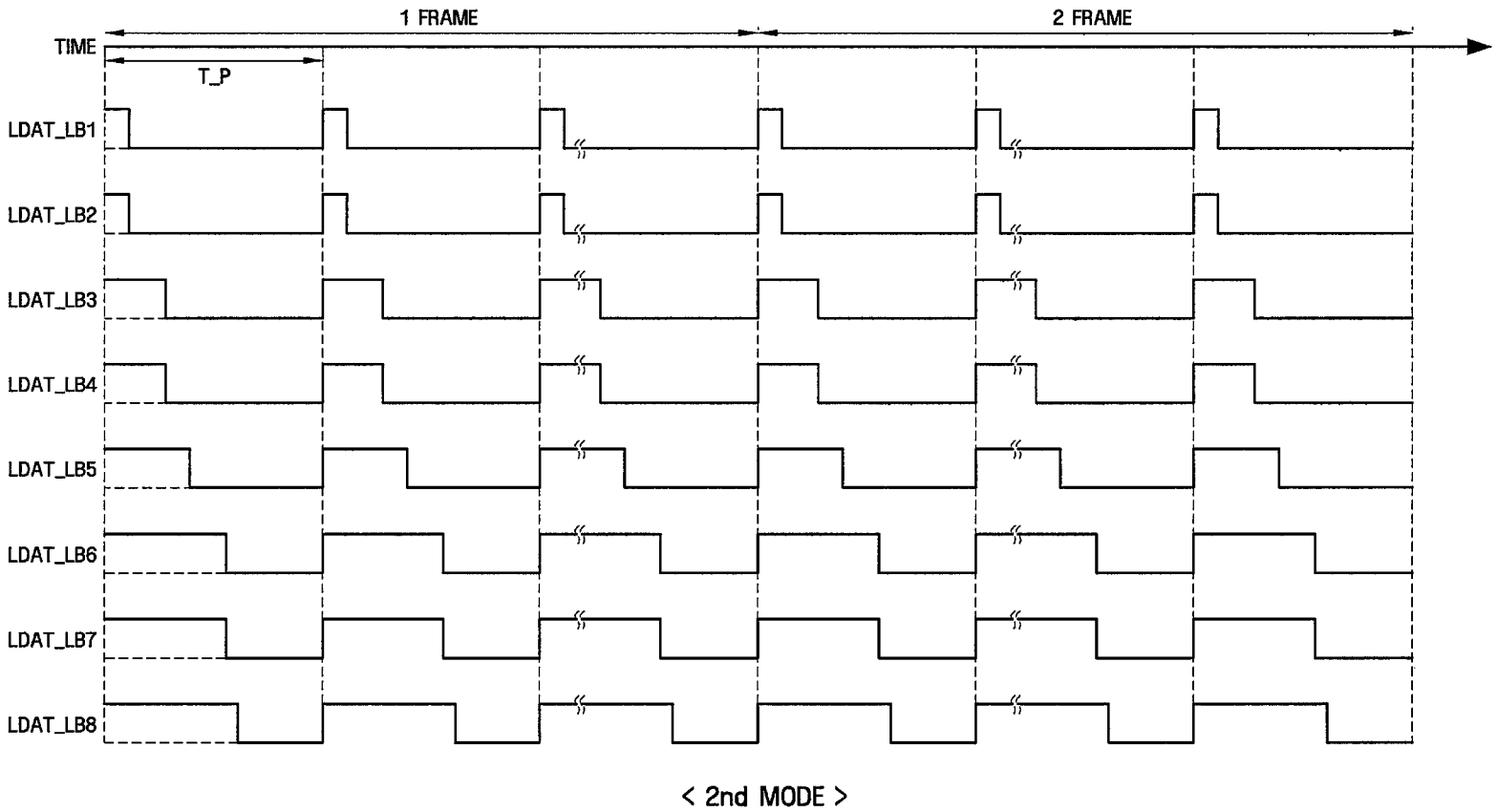
FIG. 4B is a timing diagram for explaining the operations of the first through $(n\times m)^{th}$ light-emitting blocks in the second operation mode.
Figure 5A:
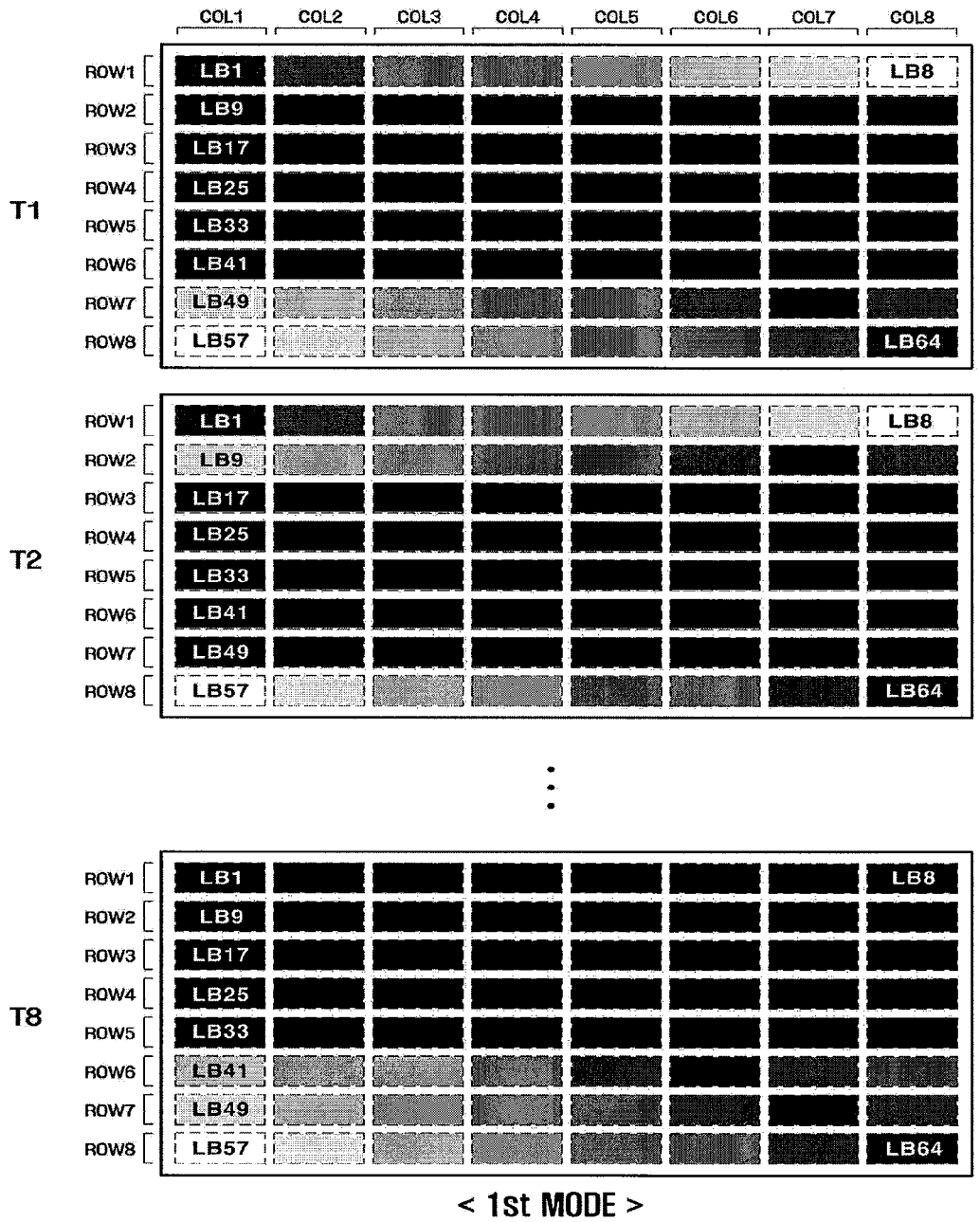
FIG. 5A is a conceptual diagram for explaining the operations of the first through $(n\times m)^{th}$ light-emitting blocks in a first operation mode.
Figure 5B:
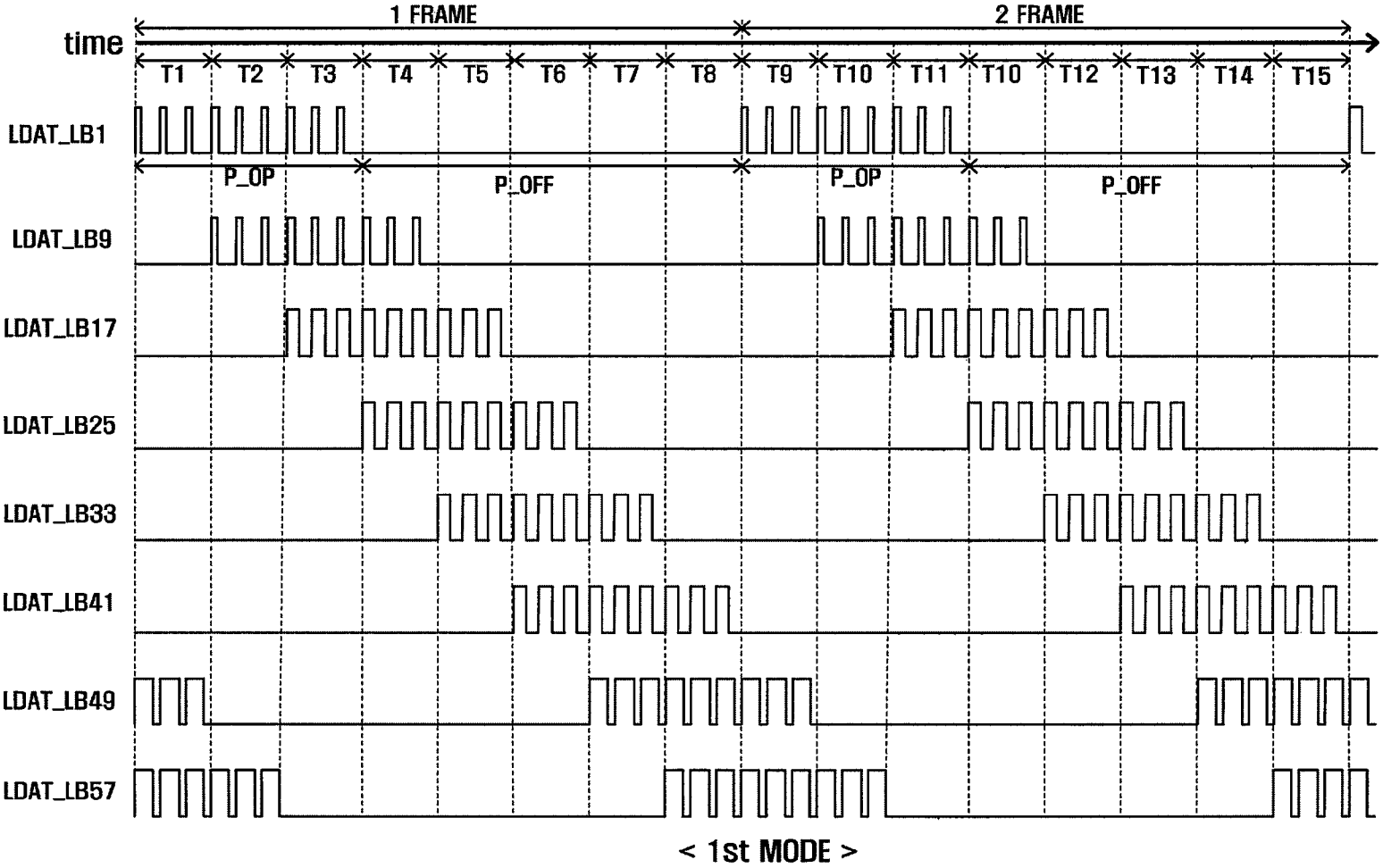
FIG. 5B is a timing diagram for explaining the operations of the first through $(n\times m)^{th}$ light-emitting blocks in the first operation mode.
Figure 6:
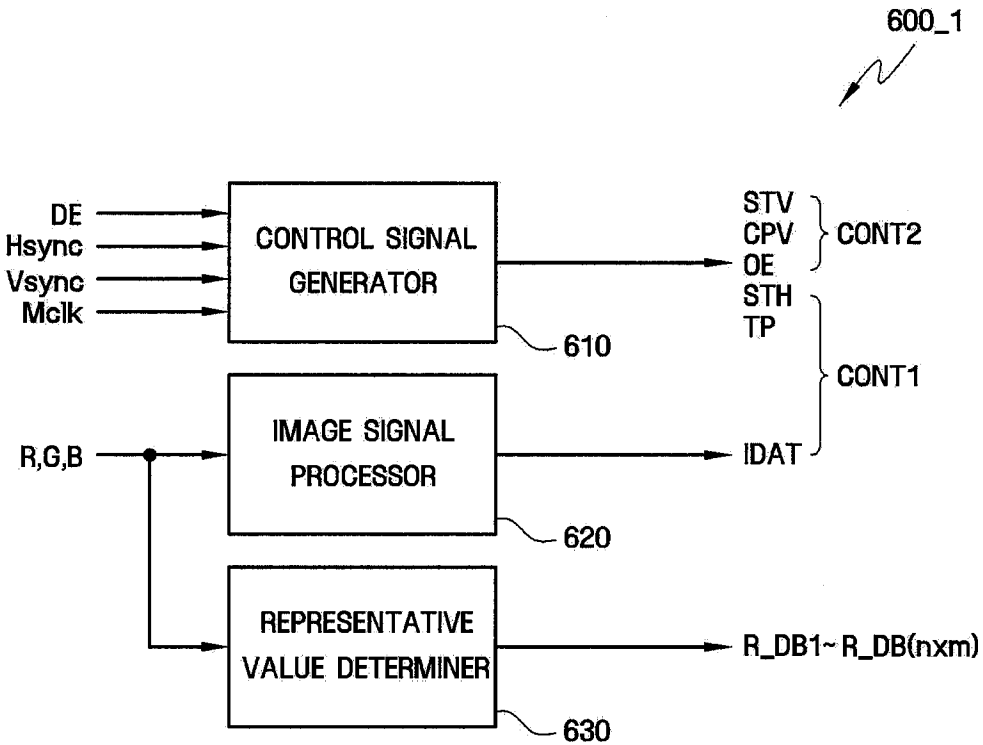
FIG. 6 is a block diagram of a first timing controller illustrated in FIG. 1.
Figure 7:
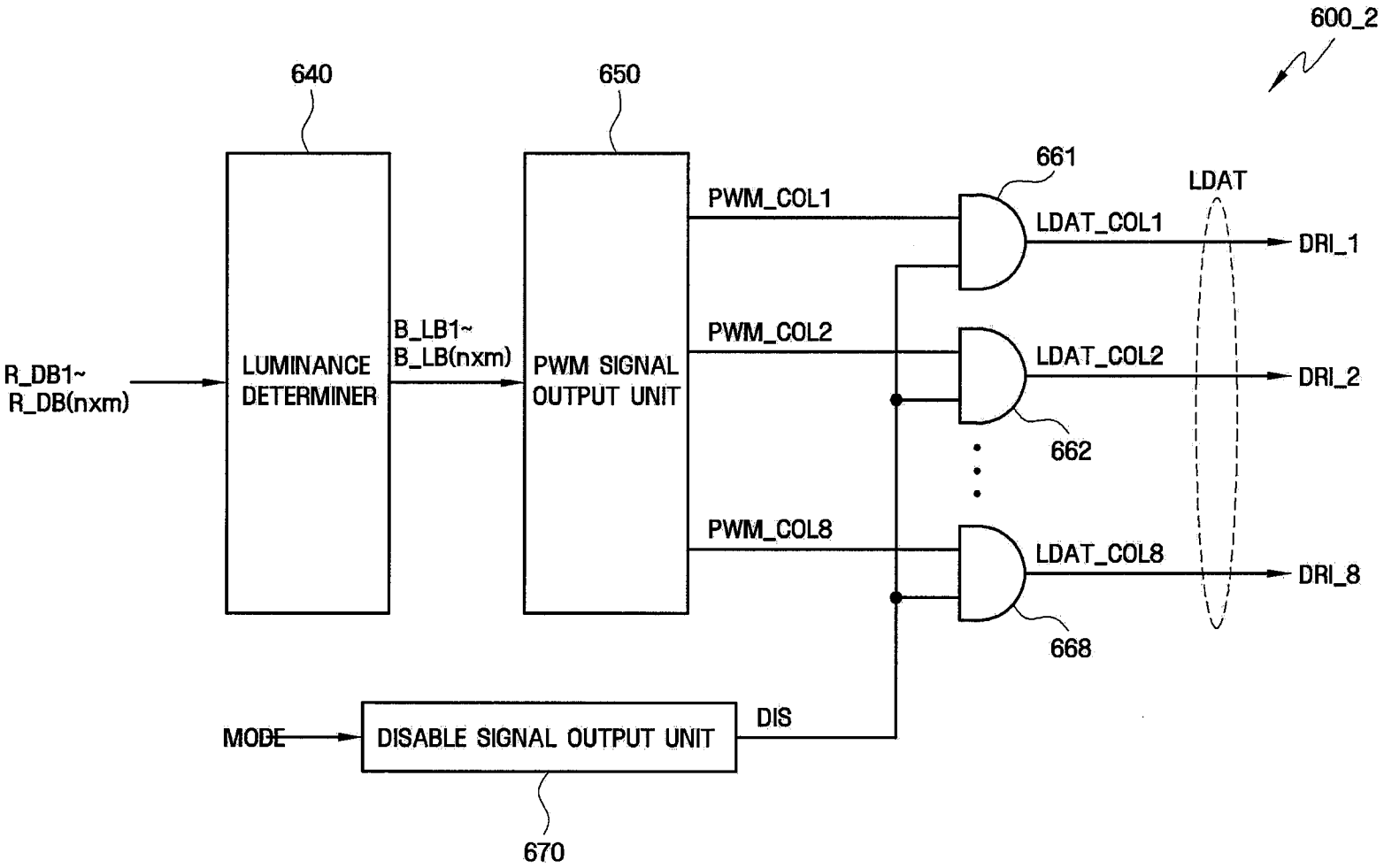
FIG. 7 is a block diagram of a second timing controller illustrated in FIG. 1.
Figure 8:
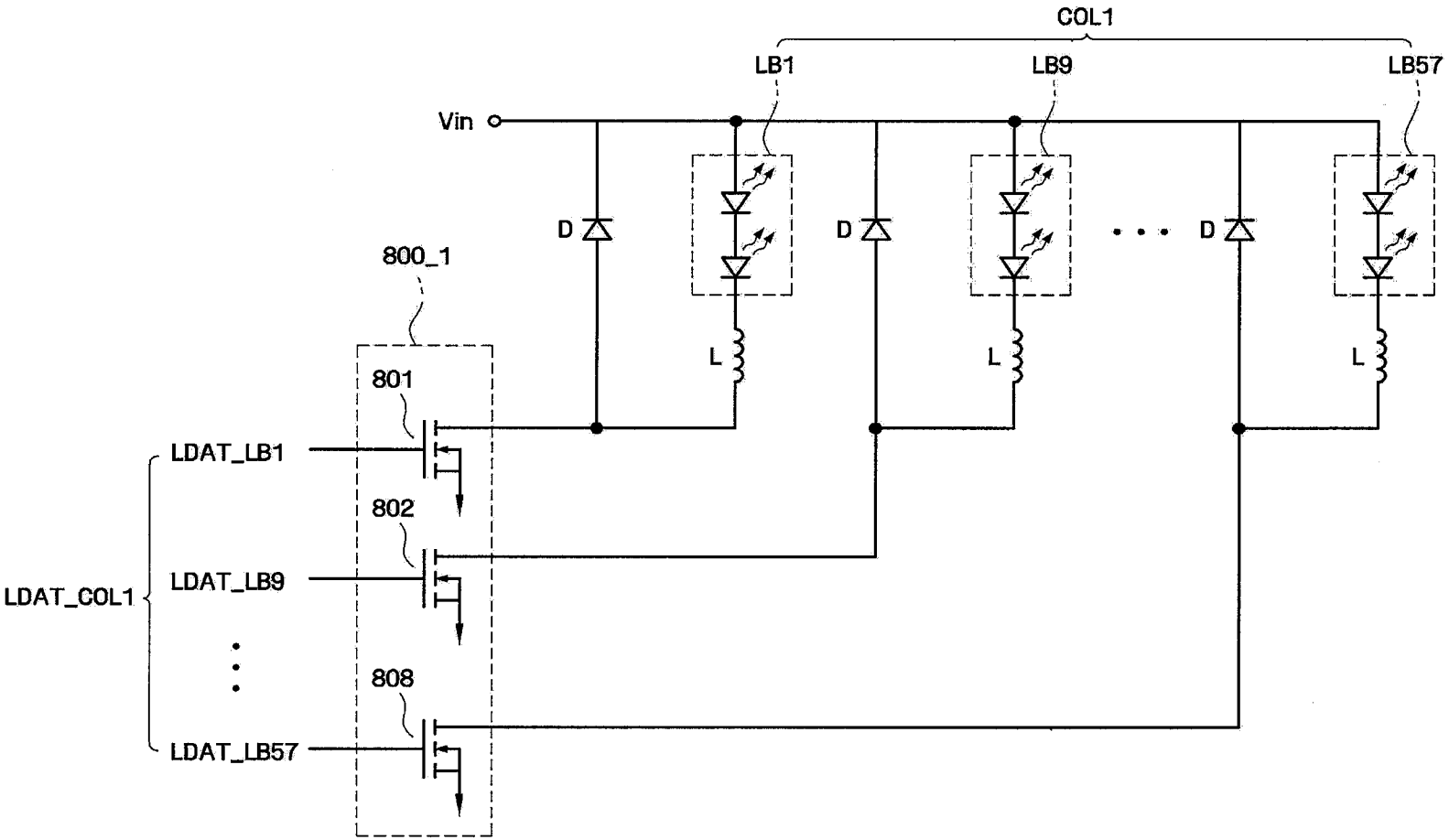
FIG. 8 is a circuit diagram for explaining the operations of a backlight driver and the first through $(n\times m)^{th}$ light-emitting blocks illustrated in FIG. 1.

An LCD and a method of driving the same according to an embodiment of the present invention will now be described with reference to FIGS. 1 through 8. FIG. 1 is a block diagram of an LCD 10 according to an embodiment of the present invention. FIG. 2 is an equivalent circuit diagram of a pixel PX. FIG. 3 is a block diagram for explaining the arrangement first through $(n\times m)^{th}$ light-emitting blocks LB1 through LB(n×m) illustrated in FIG. 1 and the connection relationship between the first through $(n\times m)^{th}$ light-emitting blocks LB1 through LB(n×m) and first through $m^{th}$ backlight drivers 800_1 through 800_m. FIG. 4A is a conceptual diagram for explaining the operations of the first through $(n\times m)^{th}$ light-emitting blocks LB1 through LB(n×m) in a second operation mode. FIG. 4B is a timing diagram for explaining the operations of the first through $(n\times m)^{th}$ light-emitting blocks LB1 through LB(n×m) in the second operation mode. FIG. 5A is a conceptual diagram for explaining the operations of the first through $(n\times m)^{th}$ light-emitting blocks LB1 through LB(n×m) in a first operation mode. FIG. 5B is a timing diagram for explaining the operations of the first through $(n\times m)^{th}$ light-emitting blocks LB1 through LB(n×m) in the first operation mode. FIG. 6 is a block diagram of a first timing controller 600_1 illustrated in FIG. 1. FIG. 7 is a block diagram of a second timing controller 600_2 illustrated in FIG. 1. FIG. 8 is a circuit diagram for explaining the operations of a backlight driver, for example, the first backlight drivers 800_1, and the first through $(n\times m)^{th}$ light-emitting blocks LB1 through LB(n×m) illustrated in FIG. 1.

Referring to FIG. 1, the LCD 10 includes a liquid crystal panel 300, a gate driver 400, a data driver 500, a timing controller 700, the first through $m^{th}$ backlight drivers 800_1 through 800_m, and the group LB of the first through $(n\times m)^{th}$ light-emitting blocks LB1 through LB(n×m) connected to the first through $m^{th}$ backlight drivers 800_1 through 800_m. In this case, the timing controller 700 may functionally be divided into the first timing controller 600_1 and the second timing controller 600_2. The first timing controller 600_1 may control an image displayed on the liquid crystal panel 300, and the second timing controller 600_2 may control the first through $m^{th}$ backlight drivers 800_1 through 800_m. The first and second timing controllers 600_1 and 600_2 may be physically separated from each other.

The liquid crystal panel 300 may be divided into first through $(n\times m)^{th}$ display blocks DB1 through DB(n×m). For example, the first through $(n\times m)^{th}$ display blocks DB1 through DB(n×m) may be arranged in an (n×m) matrix to correspond to the first through $(n\times m)^{th}$ light-emitting blocks LB1 through LB(n×m), respectively. Each of the first through $(n\times m)^{th}$ display blocks DB1 through DB(n×m) includes a plurality of pixels. The liquid crystal panel 300 includes a plurality of gate lines Gl through Gk and a plurality of data lines Dl through Dj.

FIG. 2 is an equivalent circuit diagram of one pixel PX. The pixel PX is connected to, for example, an $f^{th}$ (f=1 to k) gate line Gf and a $g^{th}$ (g=1 to j) data line Dg and includes a switching device Qp, which is connected to the $f^{th}$ gate line Gf and the $g^{th}$ data line Dg, and a liquid crystal capacitor Clc and a storage capacitor Cst which are connected to the switching device Qp. The liquid crystal capacitor Clc includes a pixel electrode PE of a first display substrate 100 and a common electrode CE of a second display substrate 200. A color filter CF is formed on a portion of the common electrode CE.

The timing controller 700 receives red, green and blue image signals R, G and B and external control signals (Vsync, Hsync, Mclk and DE) for controlling the display of the red, green and blue image signals R, G and B, and outputs an image data signal IDAT, a data control signal CONT1, a gate control signal CONT2, and an optical data signal LDAT. The timing controller 700 may receive the red, green and blue image signals R, G and B, which correspond to a first frame frequency, and output the image data signal IDAT which corresponds to a second frame frequency. Here, the second frame frequency may be greater than the first frame frequency. In addition, the timing controller 700 may provide the optical data signal LDAT which corresponds to an image displayed on each of the first through $(n\times m)^{th}$ display blocks DB1 through DB(n×m). Hereinafter, it will be assumed that the first frame frequency is 60 Hz and that the second frame frequency is 120 Hz. However, the present invention is not limited thereto.

The first timing controller 600_1 may receive the red, green and blue image signals R, G and B which correspond to a frame frequency of 60 Hz and output the image data signal IDAT which corresponds to a frame frequency of 120 Hz.

When the frame frequency is 60 Hz, the duration of a frame is approximately 16.67 ms. When the frame frequency is 120 Hz, the duration of a frame is approximately 8.33 ms. Therefore, the first timing controller 600_1 may receive the red, green and blue image signals R, G and B of one frame, which corresponds to a frame frequency of 60 Hz, and output the image data signals IDAT of two frames, each of which corresponds to a frame frequency of 120 Hz, in order to display an image during the two frames at a frame frequency of 120 Hz.

For example, when the frame frequency is 120 Hz, the image data signal IDAT of a first frame may be the input red, green and blue image signals R, G and B, and the image data signal IDAT of a second frame may be generated based on the input red, green and blue image signals R, G and B to enhance image quality by driving the liquid crystal panel 300 at high speed. Here, the first timing controller 600_1 may convert the red, green and blue image signals R, G and B into the image data signal IDAT using various methods.

In addition, the first timing controller 600_1 receives external control signals from an external source and generates the data control signal CONT1 and the gate control signal CONT2. Examples of the external control signals include a vertical synchronization signal Vsync, a horizontal synchronization signal Hsync, a main clock signal Mclk, and a data enable signal DE. The data control signal CONT1 is used to control the operation of the data driver 500, and the gate control signal CONT2 is used to control the operation of the gate driver 400. The data control signal CONT1 and the gate control signal CONT2 are provided to drive the liquid crystal panel 300 at a frame frequency of 120 Hz.

The first timing controller 600_1 receives the red, green and blue image signals R, G and B, which correspond to a frame frequency of 60 Hz, and outputs a plurality of representative image signals R_DB1 through R_DB(n×m) which correspond to the first through $(n\times m)^{th}$ display blocks DB1 through DB(n×m), respectively. That is, the first timing controller 600_1 receives the red, green and blue image signals R, G and B, determines the representative image signals R_DB1 through R_DB(n×m), which respectively correspond to the first through $(n\times m)^{th}$ display blocks DB1 through DB(n×m), and provides the representative image signals R_DB1 through R_DB(n×m) to the second timing controller 600_2. The operation and internal circuit of the first timing controller 600_1 will be described later with reference to FIG. 6.

The second timing controller 600_2 receives the representative image signals R_DB1 through R_DB(n×m) and provides the optical data signal LDAT, which corresponds to each of the representative image signals R_DB1 through R_DB(n×m), to each of the first through $m^{th}$ backlight drivers 800_1 through 800_m. The optical data signal LDAT may be obtained after a pulse width modulation (PWM) signal, which corresponds to each of the representative image signals R_DB1 through R_DB(n×m), is multiplexed with a disable signal, which turns off at least one light-emitting group, in the first operation mode. The optical data signal LDAT will be described in detail later with reference to FIG. 7.

The gate driver 400 receives the gate control signal CONT2 from the first timing controller 600_1 and transmits a gate signal to the gate lines Gl through Gk. The gate signal includes a gate-on voltage Von and a gate-off voltage Voff provided by a gate on/off voltage generator (not shown). The gate control signal CONT2 is used to control the operation of the gate driver 400 and may include a vertical start signal STV (see FIG. 6) for starting the gate driver 400, a gate clock signal CPV (see FIG. 6) for determining when to output the gate-on voltage Von, and an output enable signal OE (see FIG. 6) for determining the pulse width of the gate-on voltage Von.

The data driver 500 receives the data control signal CONT1 from the first timing controller 600_1 and applies a voltage, which corresponds to the image data signal IDAT, to the data lines Dl through Dj. The data control signal CONT1 includes signals used to control the operation of the data driver 500. Here, the signals used to control the operation of the data driver 500 include a horizontal start signal STH for starting the data driver 500 and an output instruction signal TP for instructing the output of an image data voltage.

The first through $m^{th}$ backlight drivers 800_1 through 800_m controls the luminances of the first through $(n\times m)^{th}$ light-emitting blocks LB1 through LB(n×m), respectively, in response to the optical data signal LDAT.

The first through $(n\times m)^{th}$ light-emitting blocks LB1 through LB(n×m) may be arranged, for example, as illustrated in FIG. 3. That is, the first through $(n\times m)^{th}$ light-emitting blocks LB1 through LB(n×m) may be arranged in an (n×m) matrix to correspond to the first through $(n\times m)^{th}$ display blocks DB1 through DB(n×m), respectively. Each of the first through $(n\times m)^{th}$ light-emitting blocks LB1 through LB(n×m) includes a light-emitting diode (LED). For example, each of the first through $m^{th}$ backlight drivers 800_1 through 800_m may be connected to a column of light-emitting blocks to control the luminance of each of the light-emitting blocks in the column.

The first through $(n\times m)^{th}$ light-emitting blocks LB1 through LB(n×m) may operate in a first operation mode and a second operation mode. If the first through $(n\times m)^{th}$ light-emitting blocks LB1 through LB(n×m) are divided into a plurality of light-emitting groups, each including at least one of the first through $(n\times m)^{th}$ light-emitting blocks LB1 through LB(n×m), a frame corresponding to the second frame frequency of 120 Hz includes an off section, in which at least one light-emitting group is turned off, in the first operation mode. However, the frame corresponding to the second frame frequency does not include an off section in the second operation mode. The luminance of each of the first through $(n\times m)^{th}$ light-emitting blocks LB1 through LB(n×m) may be controlled according to an image displayed on each of the first through $(n\times m)^{th}$ display blocks DB1 through DB(n×m).

Hereinafter, the operations of the first through $(n\times m)^{th}$ light-emitting blocks LB1 through LB(n×m) in each operation mode will be described in detail. To this end, it will be assumed that the first through $(n\times m)^{th}$ light-emitting blocks LB1 through LB(n×m) are arranged in an 8×8 matrix (n=m=8) and that a light-emitting group is a row of light-emitting blocks of the 8×8 matrix. However, the present invention is not limited thereto. For convenience of description, the operations of the first through $(n\times m)^{th}$ light-emitting blocks LB1 through LB(n×m) in the second operation mode will first be described with reference to FIGS. 4A and 4B.

FIG. 4A illustrates the luminance of each of the first through $(n\times m)^{th}$ light-emitting blocks LB1 through LB(n×m). As described above, the timing controller 700 provides the optical data signals LDAT, which respectively correspond to the respective representative image signals R_DB1 through R_DB(n×m) of the first through $(n\times m)^{th}$ display blocks DB1 through DB(n×m), to the first through $m^{th}$ backlight drivers 800_1 through 800_m, respectively. Therefore, as illustrated in FIG. 4A, each of the first through $(n\times m)^{th}$ light-emitting blocks LB1 through LB(n×m) may have a different luminance.

A method of controlling the luminance of each of the first through $(n\times m)^{th}$ light-emitting blocks LB1 through LB(n×m) as illustrated in FIG. 4A is provided in FIG. 4B. Referring to FIG. 4B, first through eighth optical data signals LDAT_LB1 through LDAT_LB8 are transmitted to the first through eighth light-emitting blocks LB1 through LB8 for two frames.

In the present embodiment, the first timing controller 600_1 provides the representative image signals R_DB1 through R_DB(n×m), which correspond to the frame frequency of 60 Hz, to the second timing controller 600_2. Thus, the first through eighth optical data signals LDAT_LB1 through LDAT_LB8 may be determined by the representative image signals R_DB1 through R_DB(n×m), respectively. Therefore, as illustrated in FIG. 4B, the first through eighth optical data signals LDAT_LB1 through LDAT_LB8 of a first frame may be identical to those of a second frame. On the other hand, if the first timing controller 600_1 provides the representative image signals R_DB1 through R_DB(n×m), which correspond to the frame frequency of 120 Hz, to the second timing controller 600_2, the first through eighth optical data signals LDAT_LB1 through LDAT_LB8 may be determined by the representative image signals R_DB1 through R_DB(n×m) which correspond to the frame frequency of 120 Hz. In this case, the first through eighth optical data signals LDAT_LB1 through LDAT_LB8 of the first frame may be different from those of the second frame, which will be described later as another embodiment of the present invention.

The first through eighth optical data signals LDAT_LB1 through LDAT_LB8 may be PWM signals. That is, for a period of time T_P, electric current may flow through the LED of each of the first through eighth light-emitting blocks LB1 through LB8 in a section in which the first through eighth optical data signals LDAT_LB1 through LDAT_LB8 are in a high level and may not flow through the LED of each of the first through eighth light-emitting blocks LB1 through LB 8 in a section in which the first through eighth optical data signals LDAT_LB1 through LDAT_LB8 are in a low level. For example, for the period of time T_P, a section in which the first optical data signal LDAT_LB1 provided by the first light-emitting block LB1 is in a high level may be shorter than a section in which the eighth optical data signal LDAT_LB8 provided by the eighth light-emitting block LB8 is in a high level. Accordingly, the luminance of the first light-emitting block LB1 is lower than that of the eighth light-emitting block LB8.

In summary, the luminance of each of the first through sixty-fourth light-emitting blocks LB1 through LB64 may be determined by a duty ratio of each of the first through eighth optical data signals LDAT_LB1 through LDAT_LB8 for the period of time T_P. In the second operation mode, a section in which light-emitting groups, that is, first through eighth rows ROW1 through ROW8, are turned off during each frame does not exist.

Next, the operations of the first through sixty-fourth light-emitting blocks LB1 through LB64 in the first operation mode will be described with reference to FIGS. 5A and 5B.

FIG. 5A illustrates the luminance of each of the first through sixty-fourth light-emitting blocks LB1 through LB64 over time. Some of the first through sixty-fourth light-emitting blocks LB1 through LB64, which are not colored in black, operate as in the second operation mode. That is, the luminances of some of the first through sixty-fourth light-emitting blocks LB1 through LB64, which are not colored in black, are controlled by corresponding the representative image signals R_DB1 through R_DB(n×m) which correspond to the first through $(n\times m)^{th}$ display blocks DB1 through DB(n×m), respectively. In addition, some of the first through sixty-fourth light-emitting blocks LB1 through LB 64, which are colored in black, are not turned off during each time period. That is, an off section in which at least one light-emitting group, for example, five of the first through eighth rows ROW1 through ROW8, are turned off exists in the first operation mode.

Referring to FIG. 5B, first through fifty-seventh optical data signals LDAT_LB1 through LDAT_LB57 are transmitted to the first light-emitting block LB1 of the first row ROW1, the ninth light-emitting block LB9 of the second row ROW2, the seventeenth light-emitting block LB17 of the third row ROW3, the twenty-fifth light-emitting block LB25 of the fourth row ROW4, the thirty-third light-emitting block LB33 of the fifth row ROW5, forty-first light-emitting block LB41 of the sixth row ROW6, forty-ninth light-emitting block LB49 of the seventh row ROW7, and the fifty-seventh light-emitting block LB57 of the eighth row ROW8, respectively. For convenience of description, the operations of the first through eighth rows ROW1 through ROW8 will be described using the first, ninth, seventeenth, twenty-fifth, thirty-third, forty-first, forty-seventh, and fifty-seventh light-emitting blocks LB1, LB9, LB17, LB25, LB33, LB41, LB49 and LB57.

Referring to FIGS. 5A and 5B, in the first operation mode, a frame includes an operation section P_OP and an off section P_OFF. In the operation section P_OP, the first through eighth rows ROW1 through ROW8 are not turned off, and the luminances of the first through sixty-fourth light-emitting blocks LB1 through LB64 are controlled by the representative image signals R_DB1 through R_DB(n×m), respectively. In the off section P_OFF, at least one light-emitting group, i.e., at least one of the first through eighth rows ROW1 through ROW8, is turned off.

More specifically, for a first period of time T1, the luminances of the first, seventh and eighth rows ROW1, ROW7 and ROW8 are controlled by the first, forty-ninth, and fifty-seventh optical data signals LDAT_LB1, LDAT_LB49 and LDAT_LB57 as in the second operation mode, and the second through sixth rows ROW2 through ROW6 are turned off. Here, the first, forty-ninth, and fifty-seventh optical data signals LDAT_LB1, LDAT_LB49 and LDAT_LB57 may be PWM signals.

For a second period of time T2, the luminances of the first, second and eighth rows ROW1, ROW2 and ROW8 are controlled by the first, ninth, and fifty-seventh optical data signals LDAT_LB1, LDAT_LB9 and LDAT_LB57, and the third through seventh rows ROW3 through ROW7 are turned off. Here, the first, ninth, and fifty-seventh optical data signals LDAT_LB1, LDAT_LB9 and LDAT_LB57 may be PWM signals.

Next, for an eighth period of time T8, the luminances of the sixth through eighth rows ROW6 through ROW8 are controlled by the forty-first, forty-ninth, and fifty-seventh optical data signals LDAT_LB41, LDAT_LB49 and LDAT_LB57, and the first through fifth rows ROW1 through ROW5 are turned off.

That is, in the first operation mode, a frame includes the operation section P_OP and the off section P_OFF. In the operation section P_OP, the luminances of the first through eighth rows ROW1 through ROW8 are controlled by the optical data signals LDAT_LB1, LDAT_LB9, LDAT_LB17, LDAT_LB25, LDAT_LB33, LDAT_LB41, LDAT_LB49, and LDAT_LB57, respectively as shown in FIGS. 5A and 5B. In the off section P_OFF, at least one of the first through eighth rows ROW1 through ROW8 is turned off as shown in FIGS. 5A and 5B.

As described above, if the off section P_OFF, in which at least one of the first through eighth rows ROW1 through ROW8 is turned off, exists in the first operation mode, those of the first through $(n\times m)^{th}$ display blocks DB1 through DB(n×m), which correspond to some of the first through sixty-fourth light-emitting blocks LB1 through LB64, which are turned off during the off section P-OFF, display black images. In this case, the LCD 10 may operate like a cathode ray tube (CRT) which displays a black image between every frame and the next one. When an image is displayed in this way, blurring of the image is reduced. That is, when a dynamic moving image, such as a sports image, is displayed, if the first through sixty-fourth light-emitting blocks LB1 through LB 64 operate as described above, image quality is enhanced.

The first timing controller 600_1 will be described in detail with reference to FIG. 6.

Referring to FIG. 6, the first timing controller 600_1 may include a control signal generator 610, an image signal processor 620, and a representative value determiner 630.

The control signal generator 610 receives external control signals and outputs the data control signal CONT1 and the gate control signals CONT2. For example, the control signal generator 610 may output the vertical start signal STV for starting the gate driver 400 of FIG. 1, the gate clock signal CPV for determining when to output the gate-on voltage Von, the output enable signal OE for determining the pulse width of the gate-on voltage Von, the horizontal start signal STH for starting the data driver 500 of FIG. 1, and the output instruction signal TP for instructing the output of an image data voltage.

The image signal processor 620 may receive the red, green and blue image signals R, G and B which correspond to a frame frequency of 60 Hz and output the image data signal IDAT which corresponds to a frame frequency of 120 Hz. As described above, the image signal processor 620 may receive the red, green and blue image signals R, G and B of one frame, which corresponds to a frame frequency of 60 Hz, and output the image data signals IDAT of two frames, each of which corresponds to a frame frequency of 120 Hz, in order to display an image during the two frames at a frame frequency of 120 Hz.

For example, when the frame frequency is 120 Hz, the image data signal IDAT of a first frame may be the input red, green and blue image signals R, G and B, and the image data signal IDAT of a second frame may be generated based on the input red, green and blue image signals R, G and B. Here, the image signal generator 620 may convert the red, green and blue image signals R, G and B, which correspond to a frame frequency of 60 Hz, into the image data signals IDAT, each of which corresponds to a frame frequency of 120 Hz, using various methods.

The representative value determiner 630 receives the red, green and blue image signals R, G and B which correspond to a frame frequency of 60 Hz and determines the representative image signals R_DB1 through R_DB(n×m) which correspond to the first through $(n\times m)^{th}$ display blocks DB1 through DB(n×m), respectively. For example, when the red, green and blue image signals R, G and B are transmitted intact to the first through $(n\times m)^{th}$ display blocks DB1 through DB(n×m), the representative value determiner 630 may determine a mean value of the red, green and blue image signals R, G and B provided to the first display block DB1 to be the representative image signal R_DB1 which corresponds to the first display block DB1. Alternatively, the representative value determiner 630 may determine a maximum value of the red, green and blue image signals R, G and B provided to the first display block DB1 to be the representative image signal R_DB1 which corresponds to the first display block DB1.

In this way, the representative value determiner 630 receives the red, green and blue image signals R, G and B which correspond to a frame frequency of 60 Hz, determines the representative image signals R_DB1 through R_DB(n×m) which correspond to the first through $(n\times m)^{th}$ display blocks DB1 through DB(n×m), respectively, and outputs the representative image signals R_DB1 through R_DB(n×m) to the second timing controller 600_2. However, the representative value determiner 630 may determine the representative image signals R_DB1 through R_DB(n×m) which correspond to the first through $(n\times m)^{th}$ display blocks DB1 through DB(n×m), respectively, using various methods other than the above methods.

The second timing controller 600_2 of FIG. 1 will now be described in detail with reference to FIG. 7.

Referring to FIG. 7, the second timing controller 600_2 includes a luminance determiner 640, a PWM signal output unit 650, a disable signal output unit 670, and a plurality of AND operators 661 through 668.

The luminance determiner 640 receives the representative image signals R_DB1 through R_DB(n×m) from the first timing controller 600_1, determines the luminances of the first through $(n\times m)^{th}$ light-emitting blocks LB1 through LB(n×m), and outputs luminance information B_LB1 through B_LB(n×m) of the first through $(n\times m)^{th}$ light-emitting blocks LB1 through LB(n×m) to the PWM signal output unit 650. The luminance determiner 640 may determine the luminances of the first through $(n\times m)^{th}$ light-emitting blocks LB1 through LB(n×m) which correspond to the representative image signals R_DB1 through R_DB(n×m), respectively, using a lookup table (not shown).

The PWM signal output unit 650 converts the respective luminance information B_LB1 through B_LB(n×m) of the first through $(n\times m)^{th}$ light-emitting blocks LB1 through LB(n×m) into PWM signals PWM_COL1 through PWM_COL8 and outputs the PWM signals PWM_COL1 through PWM_COL8. As described above, since each of the first through $m^{th}$ backlight drivers 800_1 through 800_m is connected to a column of light-emitting blocks, the PWM signal output unit 650 may output the PWM signals PWM_COL1 through PWM_COL8 which correspond to columns of light-emitting blocks LB1 through LB, respectively. For example, the PWM signal PWM_COL1 may include PWM signals for controlling the first, ninth, seventeenth, twenty-fifth, thirty-third, forty-first, forty-seventh and fifty-ninth light-emitting blocks LB1, LB9, LB17, LB25, LB33, LB41, LB49 and LB57.

The disable signal output unit 670 outputs a disable signal DIS in response to a mode signal MODE. The mode signal MODE may be used to instruct the first through $(n\times m)^{th}$ light-emitting blocks LB1 through LB(n×m) to operate in the first operation mode or the second operation mode. The mode signal MODE may be provided by the timing controller 700. In particular, the mode signal MODE may be used to instruct the first through $(n\times m)^{th}$ light-emitting blocks LB1 through LB(n×m) to operate in the first operation mode when a dynamic moving image, such as a sports image, is displayed. If the first through $(n\times m)^{th}$ light-emitting blocks LB1 through LB(n×m) operate only in the first operation mode, the mode signal MODE may not be provided. The disable signal DIS is used to turn off at least one light-emitting group in the off section P_OFF illustrated in FIG. 5B. The disable signal DIS may have a first level in the first operation mode and a second level in the second operation mode. For example, the first level may be a low level, and the second level may be a high level.

The AND operators 661 through 668 multiplex the PWM signals PWM_COL1 through PWM_COL8 output from the PWM signal output unit 650 with the disable signal DIS and provide the multiplexing results to the first through $m^{th}$ backlight drivers 800_1 through 800_m, respectively. For example, if the disable signal output unit 670 outputs the disable signal DIS in a high level in the second operation mode, the AND operators 661 through 668 output the PWM signals PWM_COL1 through PWM_COL8 as optical data signals LDAT_COL1 through LDAT_COL8. Therefore, the optical data signals LDAT_COL1 through LDAT_COL8 are as in FIG. 4B.

On the other hand, if the disable signal output unit 670 outputs the disable signal DIS in a high level in the first operation mode, the AND operators 661 through 668 output the PWM signals PWM_COL1 through PWM_COL8 as the optical data signals LDAT_COL1 through LDAT_COL8. Therefore, the optical data signals LDAT_COL1 through LDAT_COL8 are as in the operation section P_OP of FIG. 5B. If the disable signal output unit 670 outputs the disable signal DIS in a low level in the first operation mode, the AND operators 661 through 668 output the optical data signals LDAT_COL1 through LDAT_COL8 in a low level. Therefore, the optical data signals LDAT_COL1 through LDAT_COL8 are as in the off section P_OFF of FIG. 5B.

The operations of a backlight driver, for example, the first backlight driver 800_1, and the first through $(n\times m)^{th}$ light-emitting blocks LB1 through LB(n×m) illustrated in FIG. 1 will be described with reference to FIG. 8. For convenience of description, it will be assumed that the first backlight driver 800_1 controls the first through fifty-seventh light-emitting blocks LB1 through LB57.

Referring to FIG. 8, the first backlight driver 800_1 includes a plurality of switching devices 801 through 808 and controls the luminances of the first through fifty-seventh light-emitting blocks LB1 through LB57 in response to the optical data signals LDAT_COL1 through LDAT_COL8, respectively.

When the switching devices 801 through 808 of the first backlight driver 800_1 are turned on, a power supply voltage Vin is provided to each of the first through fifty-seventh light-emitting blocks LB1 through LB57. Accordingly, electric current flows through the first through fifty-seventh light-emitting blocks LB1 through LB57 and inductors L corresponding to the first through fifty-seventh light-emitting blocks LB1 through LB57, respectively. Here, energy generated by the electric current is stored in the inductors L. When the switching devices 801 through 808 of the first backlight driver 800_1 are turned off, each of the first through fifty-seventh light-emitting blocks LB1 through LB57, the inductor L and the diode D form a closed circuit. Thus, electric current flows through the closed circuit. Here, as the energy stored in the inductors L is discharged, the electric current is reduced. Therefore, the first backlight driver 800_1 controls the operations of the first through fifty-seventh light-emitting blocks LB1 through LB57 as illustrated in FIGS. 4B and 5B in response to the optical data signals LDAT_COL1 through LDAT_COL8.

Figure 9:
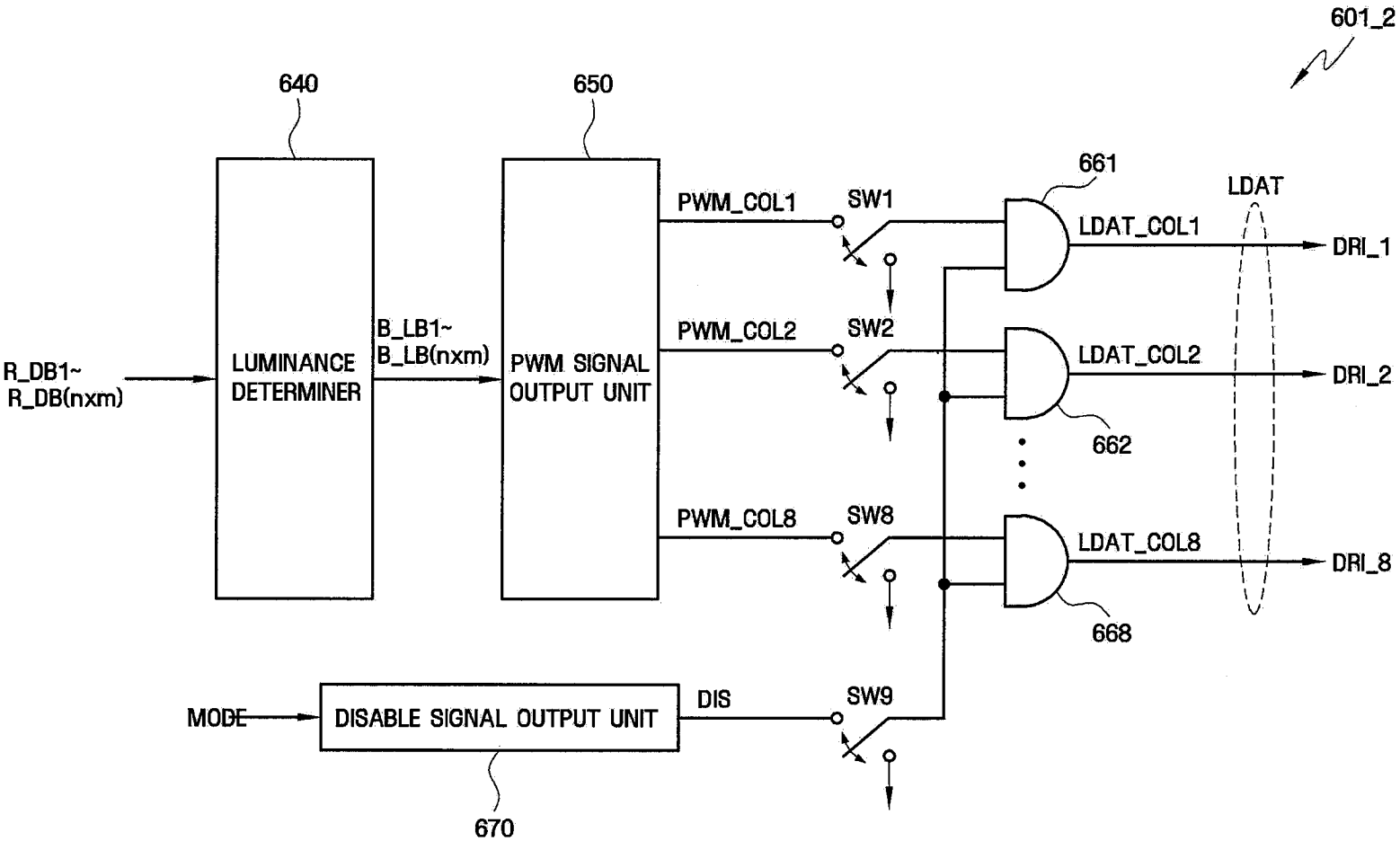
FIG. 9 is a circuit diagram of a second timing controller for explaining an LCD and a method of driving the same according to another embodiment of the present invention.

An LCD and a method of driving the same according to another embodiment of the present invention will now be described with reference to FIG. 9. FIG. 9 is a circuit diagram of a second timing controller 601_2 for explaining an LCD and a method of driving the same according to another embodiment of the present invention. Elements identical to those of the previous embodiment illustrated in FIG. 7 are indicated by like reference numerals, and thus a detailed description thereof will be omitted.

Referring to FIG. 9, the second timing controller 601_2 of the LCD according to the present embodiment further includes a plurality of switching devices SW1 through SW9.

Whenever a frame starts, the switching devices SW1 through SW9 are connected to the ground and then to a PWM signal output unit 650 or a disable signal output unit 670. That is, whenever a frame starts, the switching devices SW1 through SW9 simultaneously transmit PWM signals PWM_COL1 through PWM_COL8 to AND operators 661 through 668, respectively. Therefore, the PWM signals PWM_COL1 through PWM_COL8 can be synchronized with a disable signal DIS at every frame.

Figure 10:
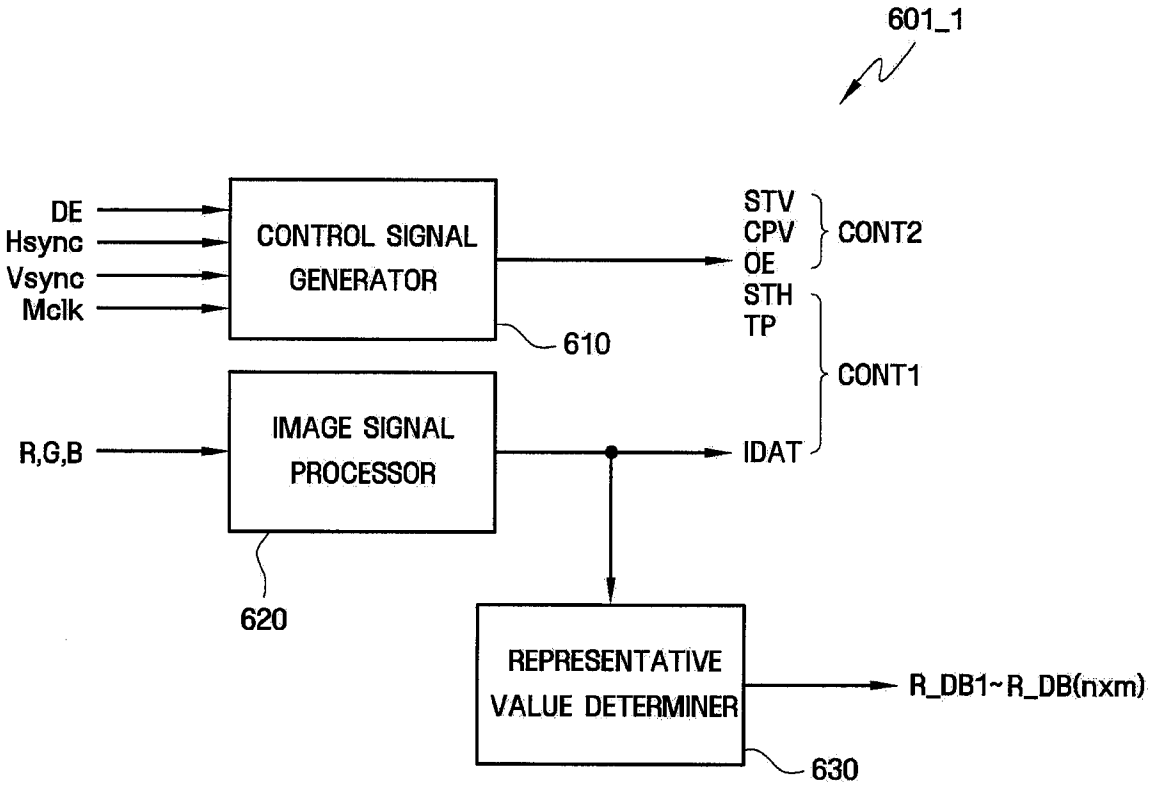
FIG. 10 is a block diagram of a first timing controller for explaining an LCD and a method of driving the same according to another embodiment of the present invention.
Figure 11A:
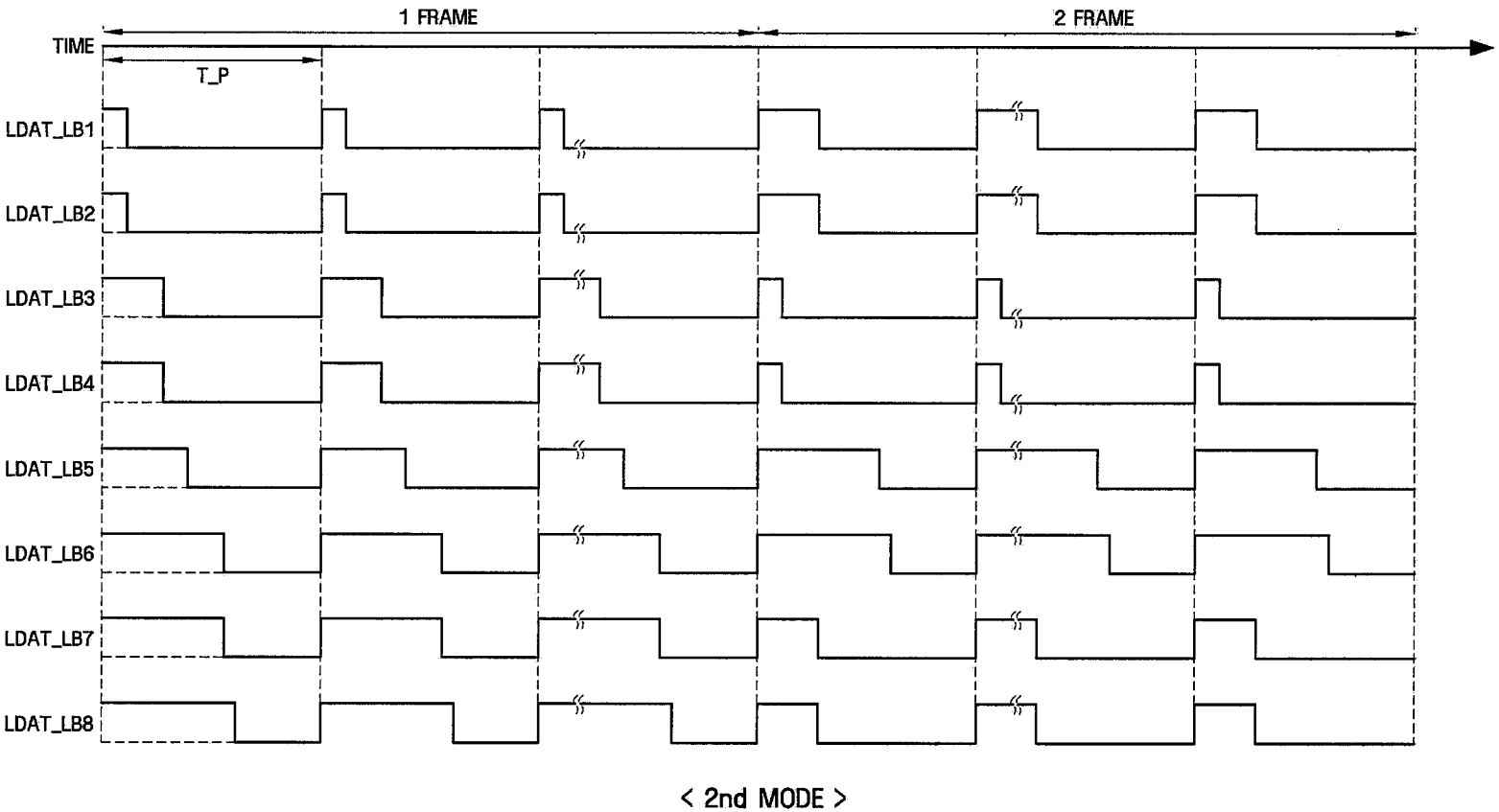
FIGS. 11A and 11B are signal diagrams for explaining the LCD and the method of driving the same according to the embodiment of FIG. 10.
Figure 11B:
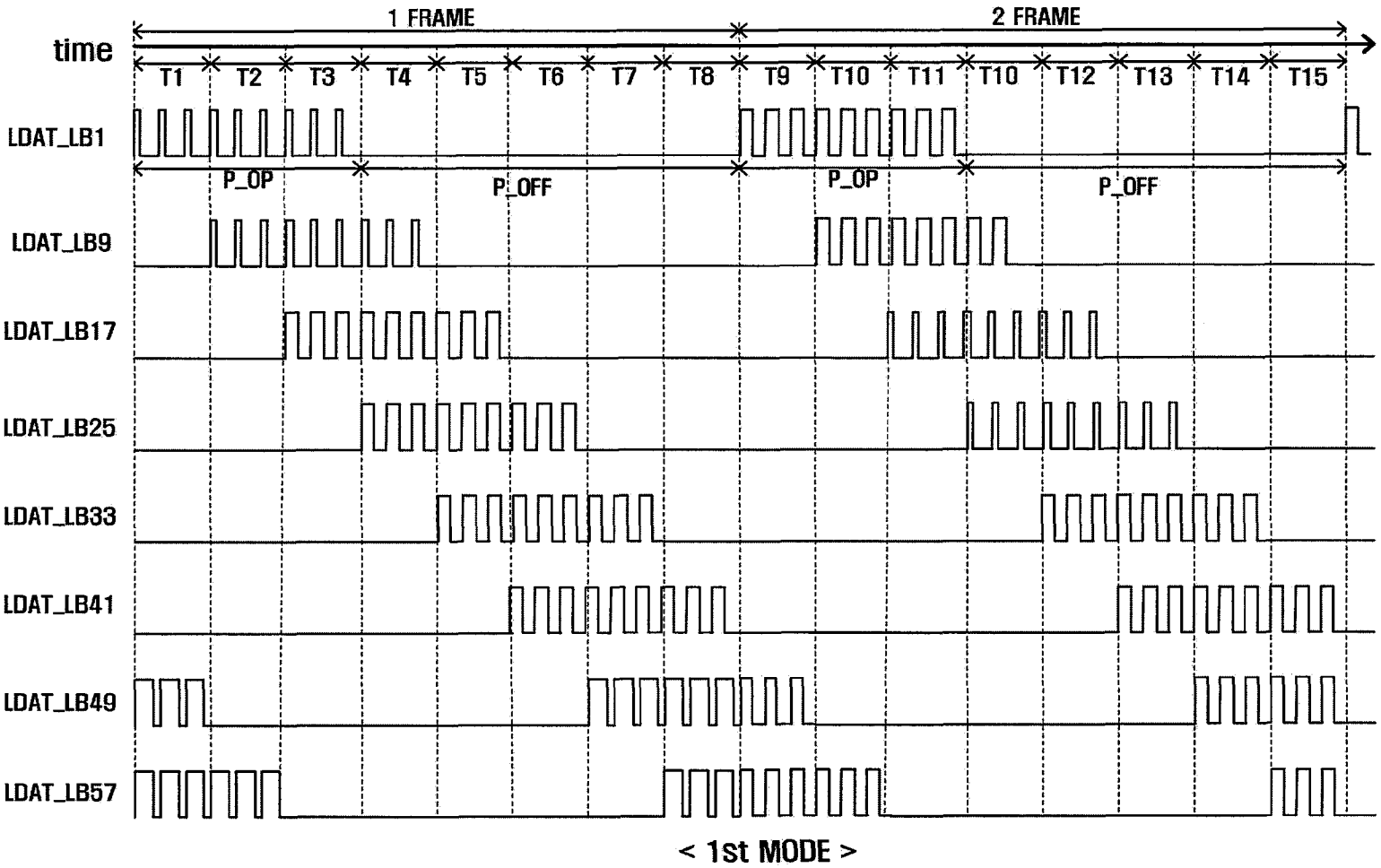

An LCD and a method of driving the same according to another embodiment of the present invention will now be described with reference to FIGS. 10 through 11B. FIG. 10 is a block diagram of a first timing controller 601_1 for explaining an LCD and a method of driving the same according to another embodiment of the present invention. FIGS. 11A and 11B are signal diagrams for explaining the LCD and the method of driving the same according to the present embodiment. Elements identical to those of the previous embodiment illustrated in FIGS. 6, 4B and 5B are indicated by like reference numerals, and thus a detailed description thereof will be omitted.

Referring to FIG. 10, a representative value determiner 630 of the first timing controller 601_1 receives an image data signal IDAT, which corresponds to a frame frequency of 120 Hz, and outputs representative image signals R_DB1 through R_DB(n×m) which correspond to first through $(n\times m)^{th}$ display blocks DB1 through DB(n×m), respectively. Therefore, the representative image signals R_DB1 through R_DB(n×m) change at every frame, which, in turn, may change optical data signals LDAT at every frame.

Referring to FIGS. 11A and 11B, unlike the first through eighth optical data signals LDAT_LB1 through LDAT_LB8 illustrated in FIGS. 4B and 5B, first through eighth optical data signals LDAT_LB1 through LDAT_LB8 may change at every frame. That is, in the previous embodiment illustrated in FIGS. 4B and 5B, the representative value determiner 630 of FIG. 6 receives the red, green and blue image signals R, G and B, which correspond to a frame frequency of 60 Hz, and provide the representative image signals R_DB1 through R_DB(n×m). Therefore, in each operation mode, the first through eighth optical data signals LDAT_LB1 through LDAT_LB8 can remain unchanged for two frames. However, in the present embodiment, the representative value determiner 630 receives the image data signal, which corresponds to a frame frequency of 120 Hz, and outputs the representative image signals R_DB1 through R_DB(n×m) which correspond to the first through $(n\times m)^{th}$ display blocks DB1 through DB(n×m), respectively. Therefore, in each operation mode, the first through eighth optical data signals LDAT_LB1 through LDAT_LB8 of a first frame may be different from those of a second frame.

Figure 12:
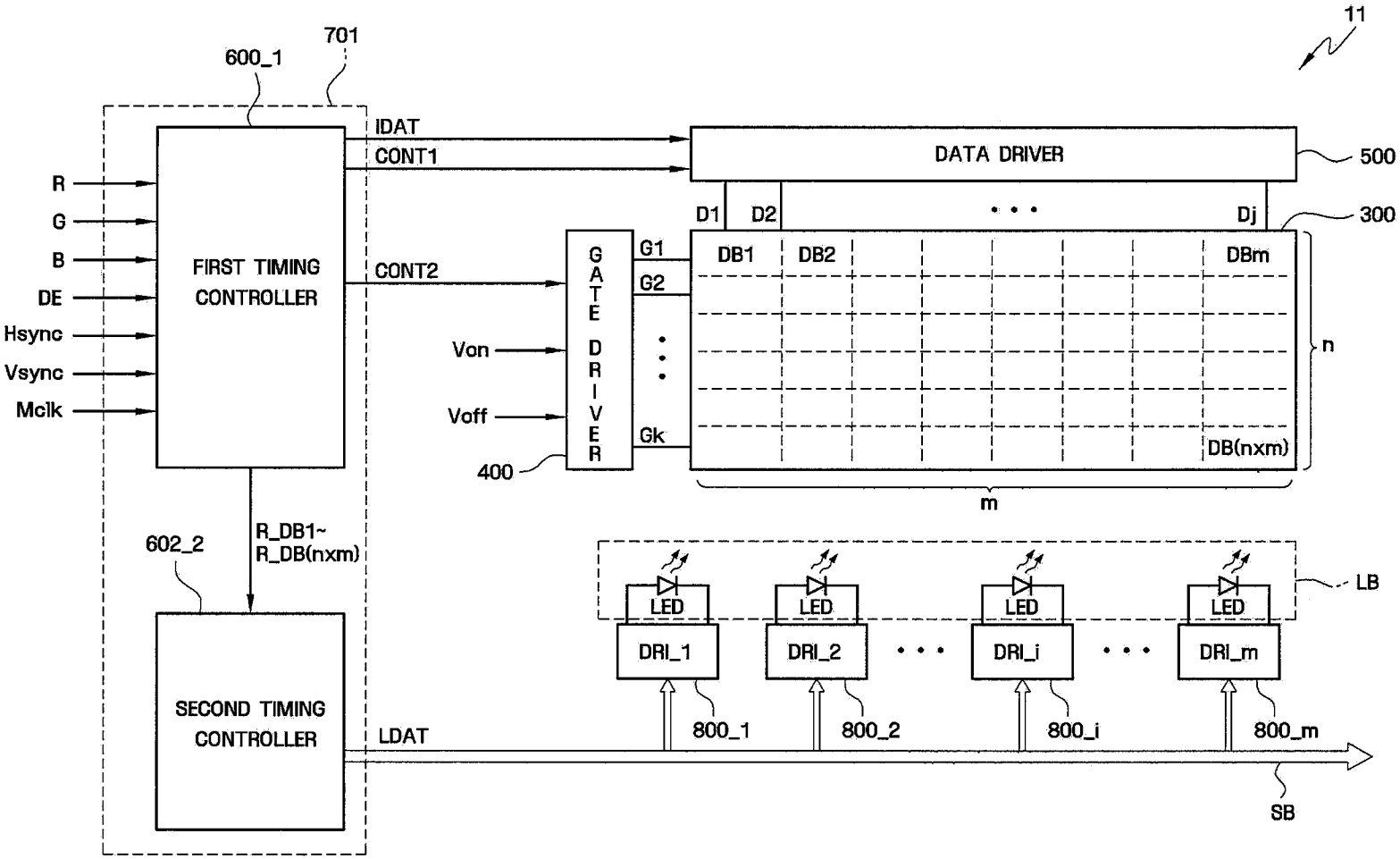
FIG. 12 is a block diagram of an LCD according to another embodiment of the present invention.
Figure 13:
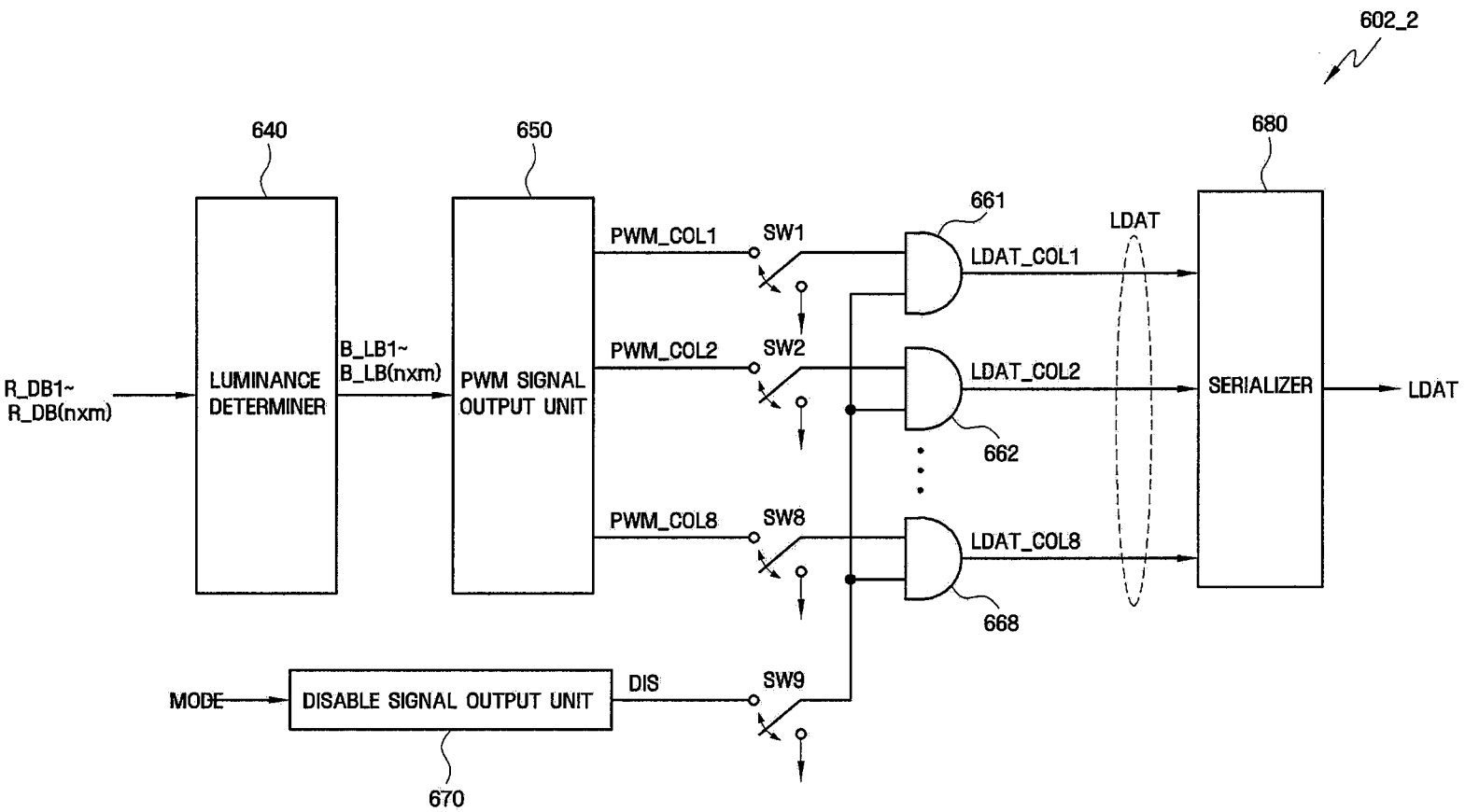
FIG. 13 is a block diagram of a second timing controller illustrated in FIG. 12.

An LCD and a method of driving the same according to another embodiment of the present invention will now be described with reference to FIGS. 12 and 13. FIG. 12 is a block diagram of an LCD 11 according to another embodiment of the present invention. FIG. 13 is a block diagram of a second timing controller 602_2 illustrated in FIG. 12. Elements identical to those of the previous embodiments illustrated in FIGS. 1 through 9 are indicated by like reference numerals, and thus a detailed description thereof will be omitted.

Referring to FIG. 12, the LCD 11 according to the present embodiment includes serially provides an optical data signal LDAT to each of first through $m^{th}$ backlight drivers 800_1 through 800_m. Here, the optical data signal LDAT may be provided through a serial bus SB.

Referring to FIG. 13, the second timing controller 602_2 further includes a serializer 680. That is, the serializer 680 receives, in parallel, optical data signals LDAT_COL1 through LDAT_COL8 from AND operators 661 through 668, respectively, and serially (e.g., digitally) outputs the optical data signals LDAT_COL1 through LDAT_COL8. The serializer 680 may be a multiplexer.

While the present invention has been particularly shown and described with reference to various embodiments thereof, it will be understood by those of ordinary skill in the art that various changes in form and detail may be made therein without departing from the spirit and scope of the present invention as defined by the following claims. The various embodiments should be considered in a descriptive sense only and not for purposes of limitation.

What is claimed is:

1. A liquid crystal display comprising:

a timing controller which receives a first image signal corresponding to a first frame frequency and outputs a second image signal corresponding to a second frame frequency;

a liquid crystal panel which receives the second image signal and displays an image at the second frame frequency; and a backlight unit including a plurality of light-emitting blocks corresponding to a plurality of pixels which provide light to the liquid crystal panel, wherein the timing controller includes a PWM signal output unit generating a PWM signal configured to be supplied to a backlight unit driver, wherein the light-emitting blocks are divided into a plurality of light-emitting groups which supply light to corresponding rows of the pixels, wherein an operation mode of the backlight unit comprises a first operation mode including first frames which include an off section in which at least one of the light-emitting groups is turned off and a second operation mode including second frames which include an on section in which a luminance of every light-emitting blocks are configured to be controlled according to images displayed on each of a display blocks, wherein the first operation mode and the second operation mode are selected by a disable signal connected to the backlight unit driver, and wherein the second operation mode includes a period in which all of the light-emitting blocks are turned on simultaneously.

2. The liquid crystal display of claim 1, wherein respective off sections of the rows sequentially start in the first operation mode.

3. The liquid crystal display of claim 1, wherein the second frame frequency is greater than the first frame frequency.

4. The liquid crystal display of claim 1, wherein each of the light-emitting blocks comprises a light-emitting diode.

5. The liquid crystal display of claim 1, wherein the second frames comprise a time period in which at least two of the light-emitting groups are turned off and in which luminance levels of at least other two of the light-emitting groups are controlled by corresponding signals, wherein the at least other two of the light-emitting groups include a first light-emitting group controlled by a first signal and a second light emitting group controlled by a second signal, the first signal having a first duty ratio in the time period, the second signal having a second duty ratio different from the first duty ratio in the time period, and wherein the at least other two of the light-emitting groups include a third light-emitting group controlled by a third signal, the third signal having the second duty ratio in the time period.

6. The liquid crystal display of claim 5, wherein the second duty ratio is larger than the first duty ratio in the time period.

7. The liquid crystal display of claim 1, wherein the second frames comprise a time period in which at least two of the light-emitting groups are turned off and in which luminance levels of at least other two of the light-emitting groups are controlled by corresponding signals, wherein the at least other two of the light-emitting groups include a first light-emitting group controlled by a first signal and a second light emitting group controlled by a second signal, the first signal having a first duty ratio in the time period, the second signal having a second duty ratio different from the first duty ratio in the time period, and wherein the first duty ratio corresponds to the image displayed in a display block corresponding to the first light-emitting group and the second duty ratio corresponds to the image displayed in a display block corresponding to the second light-emitting group.

8. The liquid crystal display of claim 1, wherein the operation mode selection is performed by an AND operators connected between the disable signal output unit and a backlight driver, and wherein all of inputs of the AND operators is connected to a ground when a frame starts.

9. The liquid crystal display of claim 1, wherein the operation mode selection is performed by an AND operators connected between the disable signal output unit and a backlight driver, and wherein all of inputs of the AND operators is synchronized at every frame.

10. A liquid crystal display comprising:

a timing controller including a first timing controller which receives a first image signal corresponding to a first frame frequency and outputs a representative image signal corresponding to the first frame frequency and a second image signal corresponding to a second frame frequency and a second timing controller which receives a representative image signal corresponding to the first frame frequency and outputs an optical data signal;

a liquid crystal panel divided into a plurality of display blocks corresponding to a plurality of pixels, the liquid crystal panel receiving the second image signal and displaying an image in the second frame frequency; and a backlight unit including a plurality of light-emitting blocks arranged in a matrix and corresponding to the display blocks, respectively, the plurality of light-emitting blocks providing light to the liquid crystal panel in response to the optical data signal, wherein the timing controller includes a PWM signal output unit generating a PWM signal to be supplied to a backlight unit driver, wherein the light-emitting blocks are divided into a plurality of light-emitting groups which supply light to corresponding rows of the pixels, wherein an operation mode of the backlight unit comprises a first operation mode including first frames which include an off section in which at least one of the light-emitting groups is turned off and a second operation mode including second frames which include an on section in which a luminance of every light-emitting blocks are configured to be controlled according to an image displayed on each of the display blocks, wherein the first operation mode and the second operation mode are selected by a disable signal output unit connected to the backlight unit driver, and wherein the second operation mode includes a period in which all of the light-emitting blocks are turned on simultaneously.

11. The liquid crystal display of claim 10, wherein, in the first operation mode, an optical data signal is obtained after a pulse width modulation signal, which controls the luminance of each of the light-emitting blocks in an operation section according to the representative image signal, is multiplexed with the disable signal which turns off one of the light-emitting groups in the off section.

12. The liquid crystal display of claim 10, wherein the first timing controller comprises:

a representative value determiner which receives the first image signal and provides the representative image signal corresponding to each of the display blocks; and an image signal processor which receives the first image signal and outputs the second image signal corresponding to the second frame frequency.

13. The liquid crystal display of claim 12, wherein the second timing controller comprises:

a luminance determiner which receives the representative image signal and determines the luminance of each of the light-emitting blocks;

a PWM signal output unit which outputs the PWM signal corresponding to the determined luminance of each of the light-emitting blocks;

the disable signal output unit which outputs a disable signal instructing the light-emitting blocks to be in the off section; and an AND operator which receives the PWM signal and the disable signal and outputs the optical data signal.

14. The LCD of claim 13, wherein the second timing controller further3 comprises a switching unit which synchronizes the PWM signal with the disable signal and provides the synchronization result to the AND operator.

15. The liquid crystal display of claim 10, wherein the second frame frequency is greater than the first frame frequency.

16. The liquid crystal display of claim 10, wherein the operation mode selection is performed by an AND operators connected between the disable signal output unit and a backlight driver, and wherein all of inputs of the AND operators is connected to a ground when a frame starts.

17. The liquid crystal display of claim 10, wherein the operation mode selection is performed by an AND operators connected between the disable signal output unit and a backlight driver, and wherein all of inputs of the AND operators is synchronized at every frame.

18. A method of driving an liquid crystal display which comprises a liquid crystal panel and a plurality of light-emitting blocks corresponding to a plurality of pixels providing light to the liquid crystal panel, the method comprising:

receiving a first image signal which corresponds to a first frame frequency and outputting a second image signal which corresponds to a second frame frequency;

receiving the second image signal and displaying an image at the second frame frequency; and providing the light to the liquid crystal panel, wherein luminance of the light-emitting blocks is determined by a PWM signals generated by a PWM signal output unit, wherein the light-emitting blocks are divided into a plurality of light-emitting groups which supply light to corresponding rows of the pixels, wherein an operation mode of the backlight unit comprises a first operation mode including first frames which include an off section in which at least one of the light-emitting groups is turned off and a second operation mode including first frames which include an on section in which a luminance of every light-emitting blocks are configured to be controlled according to an image displayed on each of a display blocks, and wherein the first operation mode and the second operation mode are selected by a disable signal output unit connected to the backlight unit driver, and wherein the second operation mode includes a period in which all of the light-emitting blocks are turned on simultaneously.

19. The method of claim 18, wherein the operation mode selection is performed by an AND operators connected between the disable signal output unit and a backlight driver, and wherein all of inputs of the AND operators is connected to a ground when a frame starts.

20. The method of claim 18, wherein the operation mode selection is performed by an AND operators connected between the disable signal output unit and a backlight driver, and wherein all of inputs of the AND operators is synchronized at every frame.

* * * * *